US005098317A

United States Patent [19]

Lau

[11] Patent Number: 5,098,317

[45] Date of Patent: Mar. 24, 1992

[54] SLIP RESISTANT CONNECTIVE DEVICE

[75] Inventor: Frederick L. Lau, Skokie, Ill.

[73] Assignee: Switchcraft Inc., Chicago, Ill.

[21] Appl. No.: 636,309

[22] Filed: Dec. 31, 1990

[51] Int. Cl.[5] ..... H01R 4/48

[52] U.S. Cl. ..... 439/729; 439/669

[58] Field of Search ..... 349/668, 669, 725, 729, 349/864, 775, 796, 438–441, 372, 786, 787

[56] References Cited

U.S. PATENT DOCUMENTS

| | | | |
|---|---|---|---|
| 1,552,227 | 9/1925 | Pacent | 439/669 |
| 1,819,040 | 8/1931 | Schellenger | 439/669 |
| 3,579,283 | 5/1971 | Welburn | 439/729 |
| 3,686,622 | 8/1972 | Bonhomme | 439/787 |
| 3,973,822 | 8/1976 | Sugimoto | 439/864 |
| 4,061,408 | 12/1977 | Bast et al. | 439/729 |
| 4,761,143 | 8/1988 | Owens et al. | 439/725 |

*Primary Examiner*—Larry I. Schwartz
*Assistant Examiner*—Hien D. Vu
*Attorney, Agent, or Firm*—William R. Clark; Richard M. Sharkansky

[57] ABSTRACT

An interlock device having a slip resistant feature. A strip conductor is disposed in a dielectric housing and is electrically connected to a tip terminal plug. The strip conductor has an angled end distal from the tip terminal plug. A spring clamp is disposed in the dielectric housing and is pivotally coupled thereto. The angled end of the strip conductor and the spring clamp are adapted for clamping a conductor wire therebetween. The spring clamp exerts pressure on the conductor wire to maintain it in a fixed position and in contact with the strip conductor and the tip terminal plug.

8 Claims, 2 Drawing Sheets

SLIP RESISTANT CONNECTIVE DEVICE

BACKGROUND OF THE INVENTION

1. Field of the Invention

This invention relates generally to electrical connective devices and is concerned more particularly with an electrical connective device having resilient pressure means for electrically connecting a wire conductor to the device.

2. Discussion the Prior Art

There has been developed in the prior art a number of connective devices of the resilient pressure type which employ spring biased members for automatically connecting respective wire conductors to the devices. Generally, a connective device of the resilient pressure type comprises a housing having a port aligned with a spring contact member within the housing. A bare end portion of a wire conductor may be inserted longitudinally through the port and into engagement with the spring contact member for electrically connecting the wire conductor to the device. Thus, the desired electrical connection may be achieved without requiring removal and re-installation of an access cover and without requiring use of a time-consuming fastening technique.

However, if the spring contact member is disposed as an electrical interconnecting member, it may be found that the spring contact member has a cross-sectional size which is unsuitable for the passage of a maximum electrical current, particularly when current surges are apt to occur. Consequently, the spring contact member may overheat and lose its resiliency sufficiently to permit an opening of the electrical connection formed between the respective wire conductor and the associated component of the assembly. Furthermore, even when the spring contact member is not disposed as an electrical interconnecting member, it may be found that the bare end portion of the wire conductor will slide out of the port in response to a pulling force exerted on the wire conductor. Thus, a critical electrical connection may be broken and the connected circuit interrupted at a very inopportune time.

SUMMARY OF THE INVENTION

These and other disadvantages of the prior art are overcome by this invention providing a connective device of the resilient pressure type with an elongated dielectric housing having therein a spring member disposed for clamping a bare end portion of a wire conductor into electrical contact with an interconnect member of the device. Thus, the spring member of this device does not function as a electrical interconnecting element through which current is required to flow. Moreover, the interconnect member is provided with a projecting contour which cooperates with the spring member for resisting slidable movement of the bare end portion of the wire conductor relative to the housing.

The interconnect member of this device comprises an electrically conductive strip of resilient material which is disposed longitudinally in the elongated dielectric housing. First and second longitudinal portions of the interconnect member are integrally joined to one another through a supported intermediate portion of the interconnect member. The first longitudinal portion of the interconnect member terminates adjacent one end of the housing in a first end portion provided with means for electrically connecting the interconnect member to an electrical conductor which may extend externally of the housing. In an opposing end wall of the housing is a wire receiving port toward which the second longitudinal portion of the interconnect member extends in cantilever fashion and terminates adjacent the wire receiving port in a second end portion of the interconnect member. This second end portion comprises an angled end portion which projects from the plane of the second longitudinal portion and into alignment with the wire receiving port. Thus, the bare end portion of the wire conductor may be inserted longitudinally through the port and over the angled end portion of the interconnect member to lie along the second longitudinal portion thereof Overlying the second longitudinal portion of the interconnect member is an elongated opening in the housing with a rounded pintle portion adjacent one end and a rounded latching portion adjacent the opposing end of the opening. Disposed in the opening is a bar-like cover having a curved end provided with cylindrically curved contour.

The housing has vertically aligned with the interconnect member a similarly elongated access opening which has opposing first and second end portions disposed adjacent the first and second end portions, respectively, of the interconnect member. Fitted snugly into the access opening is a similarly elongated cover having a first end portion pivotally supported in the first end portion of the access opening. Also, the cover has an opposing second end portion which may be latchingly secured in the second end portion of the access opening when the cover is pivoted to a closed position. Depending from a surface of the cover adjacent the interconnect member is a spring member which moves into pressure engagement with the angled end portion of the interconnect member when the cover is closed. Thus, the cover is pivoted initially to an open position to permit the bare end portion of the wire conductor to be inserted through the port and lie along the interconnect member. Then, the cover is pivoted to the closed position and latched securely whereby the spring member clamps the bare end portion of the wire conductor into contacting electrical engagement with the angled end portion of the interconnect member.

BRIEF DESCRIPTION OF THE DRAWINGS

For a better understanding of the disclosed invention, reference is made in the following detailed description to the accompanying drawings wherein.

DESCRIPTION OF THE PREFERRED EMBODIMENT

Figure 1:
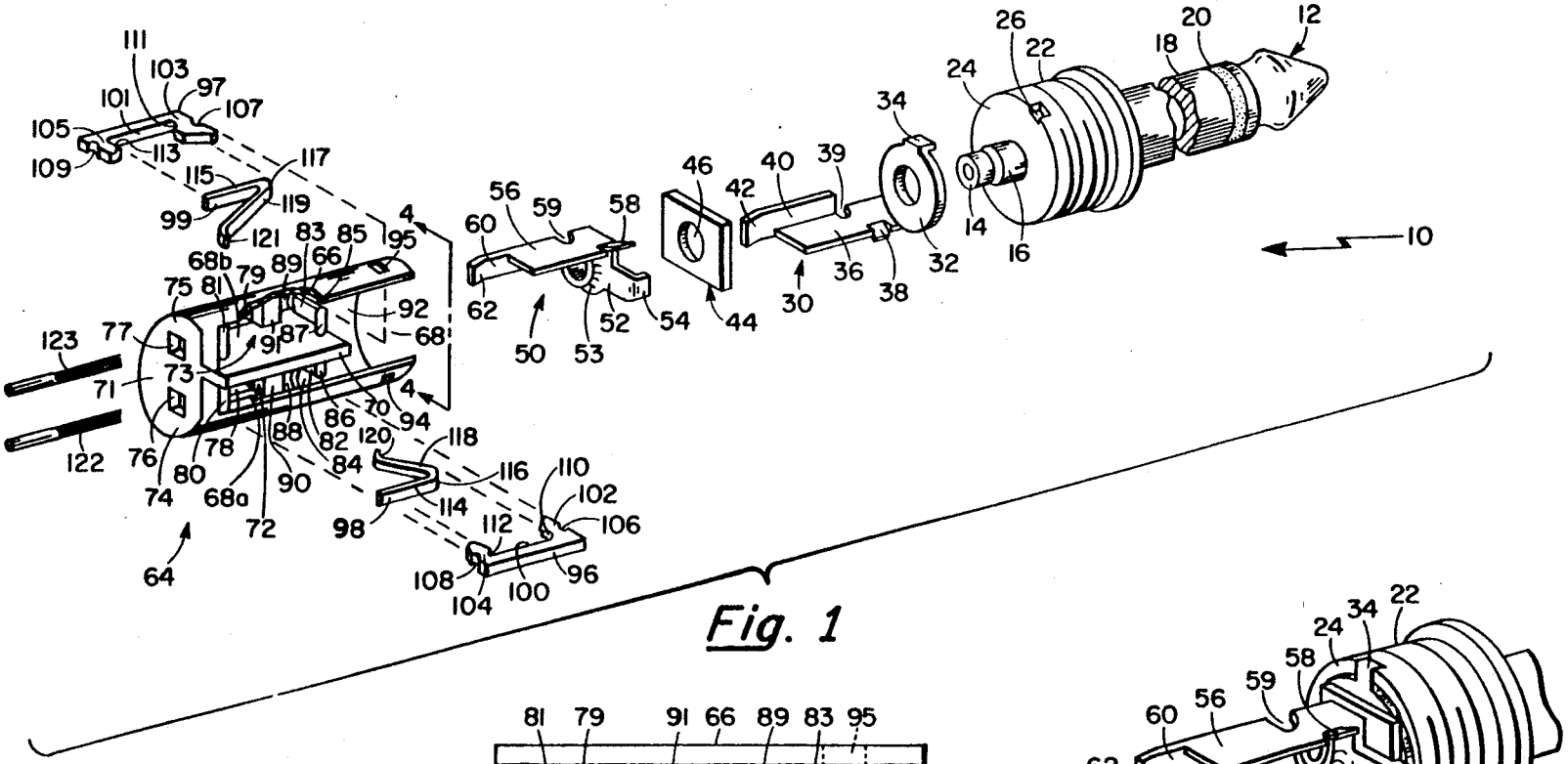
FIG. 1 is an exploded isometric view of an electrical assembly embodying this invention.

Referring to the drawings wherein like characters of reference designate like parts, there is shown in FIG. 1 an electrical connector assembly 10 of the cylindrical plug type. Connector assembly 10 includes a spear-like tip terminal 12 having an axially extending shaft 14 which is insulated by an encircling dielectric sleeve 16 from a coaxial sleeve terminal 18. The tip and sleeve terminals 12 and 18, respectively, are made of electrically conductive material, such as nickel plated brass material, for example. A leading end portion of the tip terminal 12 extends longitudinally forward of an axially aligned dielectric washer 20 which insulates it electrically from an adjacent leading end of sleeve terminal 18.

The sleeve terminal 18 is provided with an opposing end portion 22 of relatively larger diameter which has an externally threaded outer surface and terminates at a rearwardly facing end surface 24 of sleeve terminal 18. Disposed in an outer marginal portion of end surface 24 is an open end of a slotted keyway 26 which extends longitudinally of end portion 22 and has an open side in the externally threaded surface of sleeve terminal 18. End surface 24 of sleeve terminal 18 has protruding centrally therefrom a rearwardly extending end portion of dielectric sleeve 18 which has protruding therefrom a distal end portion of shaft 14. The distal end portion of shaft 14 terminates in an end surface thereof which is spaced a predetermined longitudinal distance from the end surface 24 of sleeve terminal 18.

Figure 2:
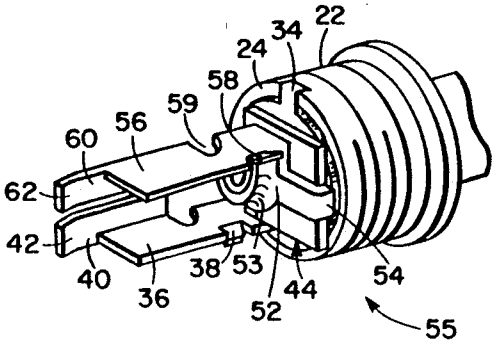
FIG. 2 is an enlarged fragmentary isometric view of the contact sub-assembly shown exploded in FIG. 1.

Assembly 10 includes an elongated sleeve interconnect member 30 which is disposed to extend longitudinally rearward of sleeve terminal 18 and is made of electrically conductive material, such as half-hard brass sheet material, for example. In fabrication, the sleeve interconnect member 30 conveniently may be made as a unitary member by use of conventional metal shaping techniques, such as stamping and bending, for examples. Sleeve interconnect member 30 has a leading end portion terminating in a transverse end ring 32 which may be disposed substantially in axial alignment with the annular end surface 24 of sleeve terminal 18. The end ring 32 has an inner diameter which is slightly larger than the outer diameter of dielectric sleeve 16 so that the end ring 32 may be placed in close encircling relationship with the adjacent end portion of dielectric sleeve 16, as shown in FIG. 2. Also, an outer peripheral portion of end ring 32 may have projecting integrally therefrom a forwardly extending orientation key 34 which is aligned with the open end of keyway 26. The key 34 may be dimensioned suitably for insertion into the open end of keyway 26 when the end ring 32 is brought into interfacing relationship with the end surface 24. Thus, the orientation key 34 is engaged in the keyway 26 to prevent rotation of end ring 32 relative to end surface 24 while the sleeve interconnect member 30 is disposed in electrical contacting relationship with the sleeve terminal 18.

End ring 32 has another outer peripheral portion which is spaced angularly from the orientation key 34 and is integrally joined to a proximal end portion of a blade-like support wall 36. The support wall 36 may be elongated, and may be positioned to serve as an outer side wall of the sleeve interconnect member 30, as shown in FIG. 2. Support wall 36 is disposed in a plane substantially orthogonal to the plane of end ring 32, and is extended longitudinally rearward therefrom in cantilever fashion. An edge portion of support wall 36 adjacent the end ring 32 has extended therein a mutually spaced pair of substantially parallel cuts for providing therebetween a flexible latching tang 38. Latching tang 38 has a pivotal end portion joined integrally to the sheet material of support wall 36, and has a distal unattached end portion projecting resiliently outward of support wall 36. Thus, the resiliently flexible tang 38 may be disposed angularly with respect to the planar support wall 36 to form an interposed acute angle which may be measured counterclockwise from the tang 38 to the plane of wall 36.

Furthermore, the support wall 36 has an opposing edge portion provided with a suitably shaped cutout, such as arcuate cutout 39, for example, which is spaced a predetermined distance from the plane of end ring 32. The cutout 39 facilitates right-angle bending of sheet material extending integrally from support wall 36 to form an elongated contact leg 40 of sleeve interconnect member 30. Contact leg 40 is substantially planar, and is disposed substantially orthogonal to the plane of support wall 36. The contact leg 40 has a proximal end portion joined integrally to a portion of support wall 36 extending longitudinally rearward of cutout 39. Also, the contact leg 40 has an opposing distal end portion which extends longitudinally rearward in cantilever fashion from a distal end portion of support wall 36.

The distal end portion of contact leg 40 is joined integrally to a relatively sloped end portion 42 of sleeve interconnect member 30. Sloped end portion 42 constitutes an integral end portion of contact leg 40 which is similarly planar and is bent out of coplanar relationship with the planar contact leg 40. As a result, the sloped end portion 42 extends rearwardly in cantilever fashion from the distal end portion of contact leg 40, and is disposed in a plane forming an obtuse angle with the planar contact leg 40. Accordingly, the end portion 42 is disposed relative to contact leg 40 at an angle in the range of about one hundred and thirty-five degrees to about one hundred and seventy-five degrees, as measured clockwise from the planar contact leg 40 to the angulated end portion 42 of sleeve interconnect member 30.

The connector assembly 10 includes a transversely disposed dielectric spacer 44 which may comprise a substantially planar wafer of rigid dielectric material, such as polycarbonate material, for example. Extended through the thickness of spacer 44 is a central aperture 46 having a diameter which is slightly larger than the outer diameter of dielectric sleeve 16. The spacer 44 is disposed for sliding over the outer surface of dielectric sleeve 16 and into interfacing relationship with the end ring 32 of sleeve interconnect member 30, as shown in FIG. 2. Dielectric spacer 44 may be provided with a generally rectangular outer periphery which is dimensioned such that one side thereof is disposed adjacent the proximal end portion of support wall 36. Thus, the proximal end portion of support wall 36 cooperates for bindingly engaging the adjacent side of rectangular spacer 44 to prevent the rotation thereof relative to the sleeve interconnect member 30.

Connector assembly 10 also may include an elongated tip interconnect member 50 which extends longitudinally rearward of dielectric spacer 44 and is aligned therewith. The tip interconnect member 50 is made of resilient electrically conductive material, such as half-hard brass material, for example, and may be fabricated as a unitary member by use of conventional metal-shaping techniques, such as stamping and bending, for examples. Tip interconnect member 50 has a leading end portion terminating in an integral end ring 52 which is disposed transversely of assembly 10 to interface with the dielectric spacer 44, as shown in FIG. 2. Integrally joined to an outer peripheral portion of end ring 52 is a coplanar leg of an anti-rotate tab 54 which has an orthogonal leg extended longitudinally of assembly 10 for frictional engagement with one side of rectangular dielectric spacer 44.

End ring 52 comprises a large diameter end portion of a generally frusto-conical collar 53 having an opposing smaller diameter end portion which is extended rearwardly of end ring 52. The smaller diameter end portion of collar 53 has a minimum inner diameter which is slightly larger than the diameter of shaft 14 protruding rearwardly from dielectric sleeve 16. Thus, the collar 53 may be pressed slidably onto the protruding end portion of shaft 14 thereby bringing the end ring 52 into interfacing relationship with dielectric spacer 44. The smaller diameter end portion of collar 53, which then closely encircles the protruding end portion of shaft 14, is attached fixedly thereto by conventional means, such as crimping, for example. As a result, there is produced, as shown in FIG. 2, a contact sub-assembly 55 having a rearward end portion comprising the end ring 32 of sleeve interconnect member 30, the dielectric spacer 44 and the end ring 52 of tip interconnect member 50 maintained in axially stacked relationship with one another. Furthermore, in the contact sub-assembly 55, the tip interconnect member 50 and the sleeve interconnect member 30 are held firmly in electrical connecting relationship with the tip terminal 12 and the sleeve terminal 18, respectively.

Spaced angularly from anti-rotate tab 54 is an outer peripheral portion of end ring 52 which is joined integrally to a proximal end portion of a blade-like support wall 56. The support wall 56 may be elongated and, in this instance, comprises an outer side wall of tip interconnect member 50, as shown in FIG. 2. Support wall 56 is disposed in a plane substantially orthogonal to the plane of end ring 52, and is extended longitudinally rearward therefrom in cantilever fashion. An edge portion of support wall 56 adjacent the end ring 52 has extended therein a mutually spaced pair of substantially parallel cuts for providing therebetween a flexible latching tang 58. Latching tang 58 has a pivotal end portion joined integrally to the sheet material of support wall 56, and has an opposing unattached end portion projecting resiliently outward of support wall 56. Thus, the resiliently flexible tang 58 forms with the plane of support wall 56 an interposed acute angle which is measured counterclockwise from the tang 58 to the planar support wall 56.

Moreover, the support wall 56 has an opposing edge portion provided with a suitably shaped cutout, such as arcuate cutout 59, for example, which is spaced a predetermined longitudinal distance from the plane of end ring 52. The cutout 59 facilitates right-angle bending of the sheet material comprising support wall 56 to form an elongated and substantially planar contact leg 60 of tip interconnect member 50. As a result, the contact leg 60 is disposed in a plane which is substantially orthogonal to the plane of support wall 56. The contact leg 60 has a proximal end portion integrally joined to a distal end portion of support wall 56, and extends longitudinally rearward thereof in cantilever fashion. Also, the contact leg 60 has an opposing distal end portion integrally joined to a similarly planar end portion 62 of the interconnect member 50. End portion 62 constitutes an integral extension of contact leg 60 which is directed rearwardly thereof in cantilever fashion. The end portion 62 is bent out of the plane of contact leg 60, and is disposed in a plane which forms an obtuse angle with the planar contact leg 60. Thus, the angulated end portion 62 is disposed relative to the contact leg 60 at an angle in the range of one hundred and thirty-five to one hundred and seventy-five degrees, as measured clockwise from the planar contact leg 60 to the angulated end portion 62.

Figure 4:
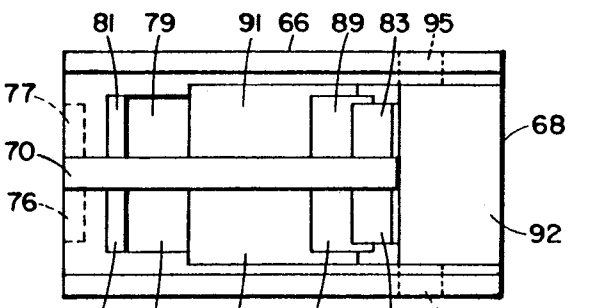
FIG. 4 is an enlarged plan view of the housing shown isometrically in FIG. 1.

As shown in FIGS. 1 and 4, the connector assembly 10 includes a generally cylindrical housing 64 having an axial centerline which extends from an open end of housing 64 to an opposing closed end thereof. Housing 64 is made of rigid dielectric material, such as molded plastic material, for example, and has a longitudinal outer wall 66 which is curved cylindrically about the axial centerline of housing 64. The outer wall 66 has opposing longitudinal edges spaced laterally apart to form therebetween a chordal access opening 68. Thus, the access opening 68 is substantially planar and has a longitudinal centerline which is disposed in substantially parallel, coextensive relationship with the axial centerline of housing 64.

Disposed orthogonally in the chordal access opening 68 is a longitudinal divider wall 70 which is substantially planar and is disposed along the centerline of opening 68 for a substantial length of housing 64. The longitudinal divider wall 70 extends laterally through the axial centerline of housing 64, and has a proximal longitudinal edge joined integrally to a coextensive aligned portion of outer wall 66. Longitudinal divider wall 70 also extends laterally through the plane of access opening 68 and terminates at a distal longitudinal edge of wall 70 which may be aligned circumferentially with the opposing longitudinal edges of outer wall 66. Accordingly, the longitudinal divider wall 70 partitions an elongated portion of housing 64 by serving as a common side wall between two longitudinally juxtaposed compartments, 72 and 73, respectively, formed within the cylindrical interior of housing 64. Furthermore, the divider wall 70 extending laterally through the plane of access opening 68 provides the compartments 72 and 73 with respective aligned portions of opening 68 comprising slot-like openings **68*a* and 68*b***, respectively.

The longitudinal divider wall 70 has an end portion joined integrally to a central portion of an orthogonal end wall 71 which constitutes the closed end of housing 64. End wall 71 has a cylindrically curved peripheral portion joined integrally to an adjacent end portion of outer wall 66. Also, end wall 71 has a chordal edge portion disposed substantially in the plane of access opening 68 and comprising coplanar end surfaces of respective portions 74 and 75 of end wall 71. The end wall portions 74 and 75 extend substantially orthogonally from respective opposing surfaces of divider wall 71 and transversely of the respective compartments 72–73 to serve as respective aligned end walls of the compartments.

End wall portions 74–75 have respective exterior surfaces from which respective wire receiving ports 76–77 extend orthogonally through the respective end wall portions 74–75 and into communication with the interiors of compartments 72–73, respectively. Within the compartments 72–73, there is disposed in respective cylindrically curved portions of outer wall 66 adjacent the respective end wall portions 74–75 respective holes 78–79. The holes 78–79 may be substantially rectangular with respective edges disposed along the divider wall 70 and respective orthogonal edges disposed along the end wall portions 74–75, respectively. Also, the holes 78–79 may comprise respective through-holes which extend entirely through the thickness of outer wall 66 to the exterior surface thereof, or may comprise respective bottomed-holes, such as recesses, for example, disposed in the interior surface of outer wall 66. Moreover, the end wall portions 74–75 have protruding integrally from portions of their inner surfaces adjacent the respective slot-like openings 68*a* and 68*b* generally cylindrical latching rails, 80–81, respectively. The latching rails 80–81 extend substantially parallel with the supporting end wall portions 74–75, respectively, and transversely of the slot-like openings 68*a* and 68*b*, respectively.

Longitudinal divider wall 70 has an opposing end portion forming an integral T-shaped junction with two transverse walls, 82 and 83, respectively, which are disposed substantially coplanar with one another. The transverse walls 82–83 extend substantially orthogonally from respective opposing surfaces of divider wall 70 and transversely of respective compartments 72–73 to serve as respective aligned end walls thereof. The lateral extensions of transverse walls 82–83 from the divider wall 70 terminate in respective distal side edges of walls 82–83 which are spaced from respective opposing portions of outer wall 66 to form respective gaps 84–85 therebetween. The spacing dimensions for the respective gaps 84–85 are slightly greater than the thickness dimensions for the supporting walls 36 and 56 of interconnect members 30 and 50, respectively. Also, the transverse walls 82 and 83 have respective arcuate ends joined integrally to coextensive aligned portions of outer wall 66 adjacent the divider wall 70.

Opposing end portions of the respective transverse walls 82–83 support in adjacent end portions of the respective compartments 72–73 hinge-like pintles 86–87, respectively. The hinge-like pintles 86–87 are generally cylindrical and may protrude integrally from portions of the respective transverse walls 82–83 adjacent the slot-like openings 68*a* and 68*b*, respectively. Thus, the pintles 86–87 are supported in substantially parallel relationship with transverse walls 82–83, respectively, and extend transversely of the slot-like openings 68*a* and 68*b*, respectively. Also, within the compartments 72–73, there is disposed in respective cylindrically curved portions of outer wall 66 adjacent the respective transverse walls 82–83 respective holes 88–89 which are similar to the respective holes 78–79. Accordingly, the holes 88–89 may be substantially rectangular with respective edges disposed along divider wall 70 and respective orthogonal edges disposed along the transverse walls 82–83, respectively. Also, the holes 88–89 may comprise respective through-holes which extend entirely through the thickness of outer wall 66, or may comprise respective bottomed-holes in the interior surface of outer wall 66.

In compartment 72, there is disposed between the holes 78 and 88 a support block 90 having a cylindrically curved peripheral portion joined integrally to an aligned portion of outer wall 66, and having a straight side joined integrally to the divider wall 70. Similarly, in compartment 73, there is disposed between the holes 79 and 89 a support block 91 having a cylindrically curved peripheral portion joined integrally to an aligned portion of outer wall 66, and having a straight side joined integrally to the divider wall 70. Moreover, the support blocks 90–91 have respective platform surfaces which are substantially flat and disposed in spaced opposing relationship with aligned portions of the slot-like openings 68*a* and 68*b*, respectively. It should be noted that the slot-like openings 68*a* and 68*b* have been described previously as juxtaposed portions of the access opening 68 which is disposed in a plane defined by the opposing longitudinal edges of cylindrically curved outer wall 66. The respective platform surfaces of support blocks 90–91 are spaced from the common plane of slot-like openings 68*a* and 68*b* by respective distances greater than the respective distances spacing therefrom the wire receiving ports 76–77.

The compartments 72–73 communicate through the respective gaps 84–85 with a trough-like chamber 92 which is disposed in an open end portion of the generally cylindrical housing 64. Chamber 92 has an outer end comprising the open end of housing 64, and has an opposing inner end formed of the transverse walls 82–83, respectively. Longitudinally, the chamber 92 is defined by an end portion of the outer wall 66 being curve cylindrically about the axial centerline of housing 64 and having opposing longitudinal edges spaced laterally apart to form an end portion of the access opening 68. In respective cylindrically curved portions of outer wall 66 adjacent the gaps 84–85, there is disposed respective detent slots 94–95 which extend substantially orthogonal to the longitudinal centerline of opening 68.

Figure 5:
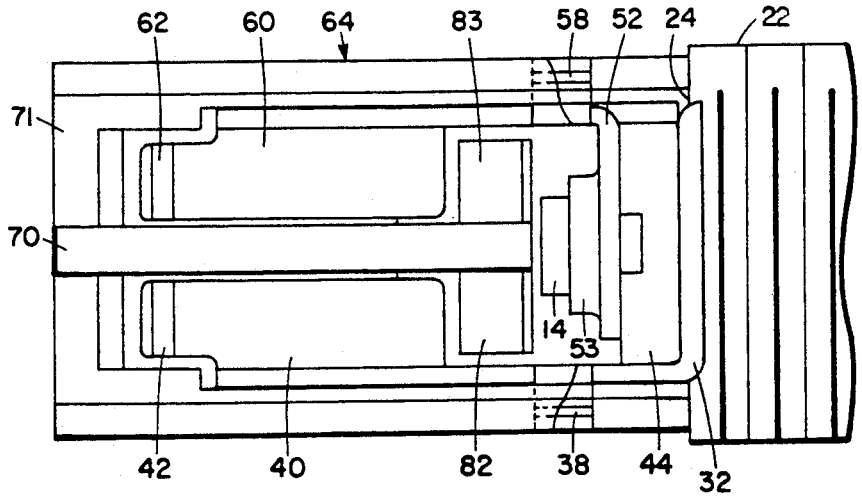
FIG. 5 is an enlarged plan view of the contact sub-assembly shown in FIG. 2 installed in the housing shown in FIG. 4.

As shown in FIG. 5, the contact sub-assembly 55 shown in FIG. 2 is mounted in the housing 64 shown in FIG. 4 by sliding the portion of divider wall 70 projecting through the planar opening 68 longitudinally between the sleeve and tip interconnect members 30 and 50, respectively. As a result, the end portion of shaft 14 protruding through the collar 53 of tip interconnect member 50 is brought into position adjacent the end of divider wall 70 joined integrally to the transverse walls 82–83, respectively. Also, the stacked array comprising the end ring 32 of sleeve interconnect member 30, the dielectric spacer 44 and the end ring 52 of tip interconnect member 50 is aligned laterally with the trough-like chamber 92. Moreover, the annular end surface 24 of sleeve terminal 18 is disposed in a plane adjacent the open end of housing 64.

The entire contact sub-assembly 55 is pressed laterally into the planar access opening 68 thereby bringing the annular end surface 24 of sleeve terminal 18 into abutting relationship with the open end of housing 64. Also, the stacked array comprising the end ring 32 of sleeve interconnect member 30, the dielectric spacer 44 and the end ring 52 of tip interconnect member 50 is moved laterally into the trough-like chamber 92. In the process, the latching tangs 38 and 58 are brought into brushing engagement with respective opposing longitudinal edges of outer wall 66. As a result, the latching tangs 38 and 58 flex resiliently inward of contact sub-assembly 55 and then flex resiliently outward thereof to engage the respective detent slots 94–95. Thus, the latching tangs 38 and 58 being disposed in the respective detent slots 94–95 lock the contact sub-assembly 55 into the housing 64.

Figure 6:
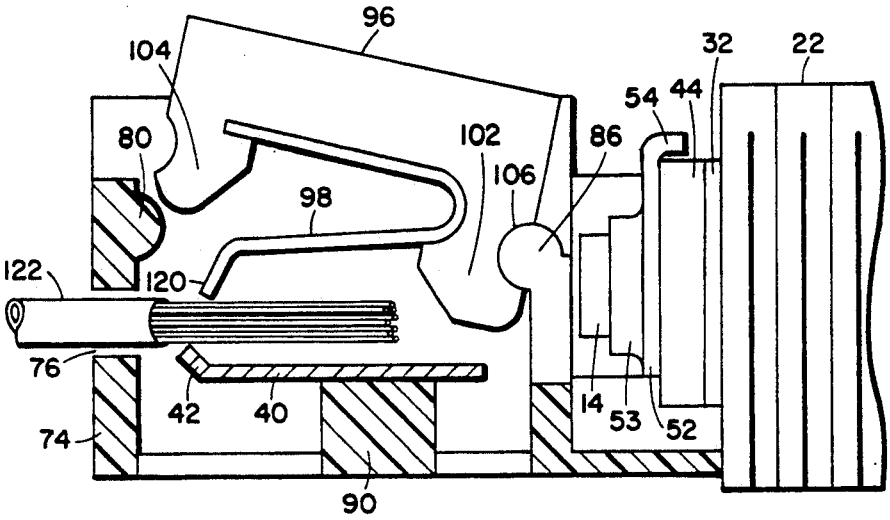
FIG. 6 is an enlarged longitudinal sectional view of one of the interconnect devices shown in FIG. 4 with a cover sub-assembly shown in FIG. 3 disposed for permitting insertion of a wire conductor shown in FIG. 1.

Furthermore, the blade-like support walls 36 and 56 of sleeve and tip interconnect members 30 and 50, respectively, slide into the gaps 84–85, respectively, thereby securing the sleeve and tip interconnect, members 30 and 50 into the desired longitudinal direction within the compartments 72–73, respectively. Also, the contact legs 40 and 60 sleeve of tip interconnect members 30 and 50 respectively, pass through the slot-like openings 68*a* and 68*b* to enter the compartments 72–73, respectively. As a result, the contact legs 40 and 60 are disposed on the platform surfaces of support blocks 90–91, respectively, and extend therefrom in cantilever fashion toward end wall 71 of housing 64. As shown in FIG. 6, the angled end portion 42 of sleeve interconnect member 30, is disposed adjacent the end wall portion 74 of compartment 72 and may protrude slightly into alignment with wire receiving port 76 thereof. Although not shown, the angled end portion 62 of tip interconnect member 50 is disposed adjacent the end wall portion 75 of compartment 73 and may protrude slightly into alignment with wire receiving port 77 thereof.

Figure 3:
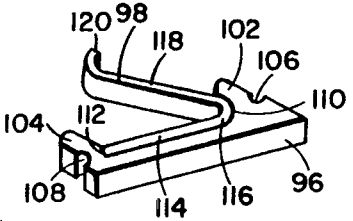
FIG. 3 is an enlarged isometric view of a cover sub-assembly shown exploded in FIG. 1

Referring to FIGS. 1 and 3, it may be seen that the connector assembly 10 includes generally U-shaped covers 96–97 having respective bight ends from which respective spring clamping members 98–99 extend between respective opposing legs of the covers. The covers 96–97 are made of resilient dielectric material, such as flexible plastic material, for example, and are provided with respective dimensions suitable for installing the covers 96–97 in the slot-like openings 68*a* and 68*b* of compartments 72–73, respectively. Bight ends of the generally U-shaped covers 96–97 are comprised of respective bar-like members 100–101 having respective inner surfaces which are disposed for facing into the respective compartments 72–73 and from which extend the spring clamping members 98–99, respectively. The inner surfaces of bar-like members 100–101 have respective end portions joined integrally to proximal neck-end portions of respective pivotal support legs 102–103, and have respective opposing end portions joined integrally to proximal neck-end portions of respective flexible latching legs 104–105, respectively.

The neck-end portions of pivotal support legs 102–103 have disposed transversely in their outer surfaces respective cylindrically curved sockets 106–107 which conform to the curvatures of pintles 86–87, respectively. Also, the neck-end portions of flexible latching legs 104–105 have disposed transversely in their outer surfaces respective cylindrically curved recesses 108–109 which conform to the curvatures of latching rails 80–81, respectively. Distal end portions of the flexible latching legs 104–105 have respective outer surfaces which are beveled and slope convergently inward toward respective inner surfaces of the latching legs 104–105 which also may be beveled. The neck-end portions of pivotal support legs 102–103 have disposed transversely in their inner surfaces cylindrically curved indentations 110–111, respectively. Moreover, the neck-end portions of flexible latching legs 104–105 have disposed transversely in their inner surfaces respective grooves 112–113.

The spring clamping members 98–99 are made of resilient material, such as nickel silver band material, for example, and are provided with respective hairpin-like configurations. Spring clamping members 98–99 have respective fixed arms 114–115 which include respective distal end portions disposed for fitting snugly into the respective grooves 112–113 provided in the inner surfaces of flexible latching legs 104–105, respectively. Opposing proximal end portions 116–117 of the fixed arms 114–115 are joined integrally to respective hairpin bend portions 116–117 of the spring clamping members 98–99, respectively. The hairpin bend portions 116–117 are pressed resiliently into the cylindrically curved indentations 110–111, respectively, provided in the inner surfaces of pivotal support legs 102–103, respectively. Thus, the resulting spring tensions developed in the fixed legs 104–105, respectively, are used as a means for securing the spring clamping members 98–99 to the covers 96–97, respectively.

Integrally joined to the hairpin bend portions 116–117 of respective spring clamping members 98–99 are proximal end portions of respective rotatable arms 118–119 which are disposed at respective acute angles relative to the respective fixed arms 114–115, when the respective covers 96–97 are mounted initially in the slot-like openings 68*a* and 68*b*, respectively. Rotatable arms 118–119 have respective distal end portions joined integrally to respective pressure applying end portions 120–121 of the spring clamping members 98–99, respectively. The pressure applying end portions 120–121 are blade-like and are disposed at respective obtuse angles relative to the rotatable arms 118–119, respectively. After the covers 96–97 are installed in the slot-like openings 68*a* and 68*b*, respectively, wire conductors 122–123 of the strand type may be inserted longitudinally through the respective ports 76–77 and into the respective compartments 72–73.

As shown in FIG. 6, the cover 96 is installed in the slot-like opening 68*a* by fitting the pintle 86 in the socket 106 disposed in the outer surface of the neck-end portion of pivotal support leg 102. Then, the cover 96 is rotated about the pintle 86 to bring the beveled outer surface of the distal end portion of flexible latching leg 104 into touching contact with the latching rail 80 in compartment 72. As a result, the pressure applying end portion 120 of the spring clamping member 98 depending from cover 96 is disposed in spaced opposing relationship with the angled end portion 42 of sleeve interconnect member 30. The bare end portion of wire conductor 122 then is inserted with zero force through the port 76 to extend between the angled end portion 42 of sleeve interconnect member 30 and the pressure applying end portion 120 of spring clamping member 98. Also, the bare end portion of wire conductor 122 extends longitudinally along the contact leg 40 of sleeve interconnect member 30.

Figure 7:
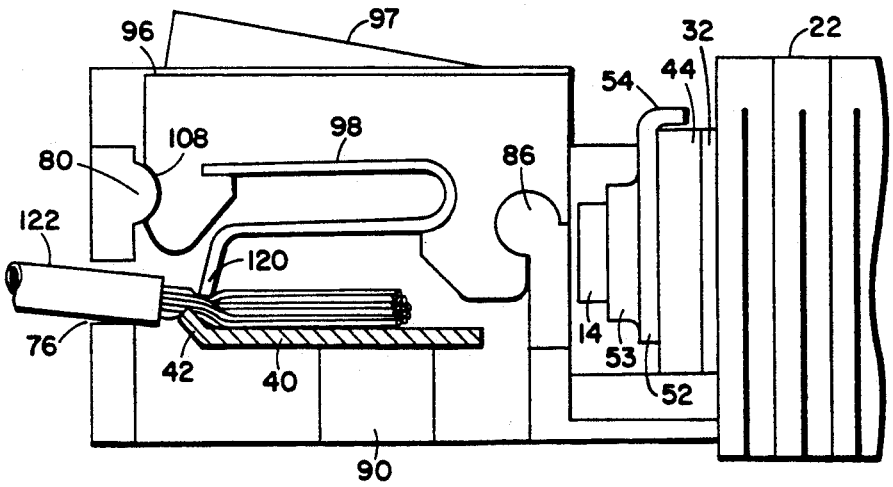
FIG. 7 is an enlarged longitudinal sectional view similar to FIG. 6 but showing the cover sub-assembly disposed for clamping the wire conductor into electrical connecting relationship with the interconnect device shown in FIG. 6.

As shown in FIG. 7, after the bare end portion of wire conductor 122 is inserted through the port 76, the cover 96 is pressed into the slot-like opening 68*a* thereby rotating the cover 96 further about the pintle 86. Consequently, the pressure applying end portion 120 of spring clamping member 98 is moved arcuately into pressure engagement with the bare end portion of wire conductor 122. As a result, the bare end portion of wire conductor 122 is pressed into electrical connecting relationship with the angled end portion of sleeve interconnect member 30. Since the contact leg 40 of sleeve interconnect member 30 extends in cantilever fashion from support block 90 and is resilient, the angled end portion 42 of sleeve interconnect member 30 may yield resiliently under the pressure exerted by the pressure applying end portion 120. Therefore, the contact leg 40 exerts a resilient pressure to return the angled end portion 42 of sleeve interconnect member 30 to its initial position. Due to the pressure exerted on the bare end portion of wire conductor 122, the conductor 122 is securely disposed in electrical contact with the angled end portion 42 of sleeve interconnect member 30. When the wire conductor 122 is pulled outwardly from port 76, the blade-like end portion 120 exerts additional pressure on conductor 122 thereby resisting such forces.

Consequently, when the beveled outer surface at the distal end portion of flexible latching leg 104 rides over the cylindrically curved surface of latching rail 80, the flexible latching leg 104 flexes to permit the latching rail 80 to settle in the cylindrically concave recess 108. As a result, the cover 96 is locked into position within the slot-like opening 68*a* of compartment 72.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

I claim:

1. An elongated solderless connector device comprising:

a tip terminal plug;

a dielectric housing disposed longitudinally to said tip terminal plug, said dielectric housing having a distal transverse wall with a port adapted for receiving a stripped end of a connector wire;

a strip conductor disposed in said housing and being electrically connected to said tip terminal plug, said strip conductor being longitudinally aligned with said tip terminal plug and having an angled end distal from said tip terminal plug; and an assembly disposed in said dielectric housing, said assembly comprising a cover and a resilient U-shaped spring clamp member having a first arm attached to said cover and a second rotatable arm, said assembly having a first end pivotally coupled to said housing and a second end pivotable between an open position spaced from said angled end and a closed position transversely adjacent to said angled end wherein, in said closed position, said angled end and said second arm of said resilient spring clamp member are adapted for clamping therebetween a conductor wire inserted through said port while said resilient spring clamp member is in said open position.

2. The connector device recited in claim 1 wherein said dielectric housing has a pintle and wherein said first end of said spring clamp member has a socket mated with said pintle.

3. The device recited in claim 1 wherein said resilient spring clamp member has a fixed arm portion and a rotatable arm portion, said rotatable arm portion being disposed at an acute angle relative to said fixed arm portion.

4. The device recited in claim 3 wherein said rotatable arm portion has a distal end portion disposed at an obtuse angle relative to said rotatable arm portion.

5. The device recited in claim 4 wherein said distal end portion is blade-like.

6. An elongated solderless connector device comprising:

a tip terminal plug;

a dielectric housing disposed longitudinally to said tip terminal plug, said dielectric housing having a distal transverse wall with a port adapted for receiving a stripped end of a conductor wire;

a strip conductor disposed in said housing and being electrically connected to said tip terminal plug, said strip conductor being longitudinally aligned with said tip terminal plug and having an angled end distal from said tip terminal plug; and a spring clamp member disposed in said dielectric housing, said spring clamp member having a first end pivotally coupled to said housing and a second end pivotable between an open position spaced from said angled end and a closed position transversely adjacent to said angled end wherein, in said closed position, said angled end and said spring clamp member are adapted for clamping therebetween a conductor wire inserted through said port while said spring clamp member is in said open position, wherein said dielectric housing comprises a rail portion and wherein said second end of said spring clamp member has a recess adapted for mating with said rail portion while said spring clamp member is in said closed position.

7. An elongated solderless connector device comprising:

a tip terminal plug;

a dielectric housing disposed longitudinally to said tip terminal plug, said dielectric housing having an inwardly extending support block;

a strip conductor disposed in said housing in longitudinal alignment with said tip terminal plug and being electrically connected to said tip terminal plug, said strip conductor being disposed on said support block and extending from said block in cantilever fashion distally from said tip terminal plug, said strip conductor having an angled end distal from said tip terminal plug; and a U-shaped spring clamp member disposed in said dielectric housing, said spring clamp member having a first end pivotally coupled to said housing and a second end pivotable between an open position spaced from said angled end and a closed position transversely adjacent to said angled end wherein, in said closed position, said angled end and said spring clamp member are adapted for clamping therebetween a conductor wire, said strip conductor being resilient so that said angled end yields from an initial position to exert a resilient pressure on said conductor wire.

8. The device recited in claim 7 wherein said spring clamp member has an end portion disposed at an intersecting angle with respect to said angled end.

* * * * *